US010512589B1

(12) United States Patent
Tran et al.

(10) Patent No.: US 10,512,589 B1
(45) Date of Patent: Dec. 24, 2019

(54) BUBBLE GENERATION SYSTEM

(71) Applicant: GULFSTREAM INC., Cambridge (CA)

(72) Inventors: Minh Sang Tran, Cambridge (CA); Chris Alexander, Cambridge (CA)

(73) Assignee: Gulfstream Inc., Cambridge (CA)

( * ) Notice: Subject to any disclaimer, the term of this patent is extended or adjusted under 35 U.S.C. 154(b) by 0 days.

(21) Appl. No.: 15/829,178

(22) Filed: Dec. 1, 2017

Related U.S. Application Data

(60) Provisional application No. 62/429,116, filed on Dec. 2, 2016.

(51) Int. Cl.
*A61H 33/02* (2006.01)
*A61H 35/00* (2006.01)
*A61H 33/00* (2006.01)

(52) U.S. Cl.
CPC ..... *A61H 33/025* (2013.01); *A61H 33/0095* (2013.01); *A61H 35/006* (2013.01); *A61H 33/028* (2013.01); *A61H 2201/0271* (2013.01); *A61H 2201/1688* (2013.01)

(58) Field of Classification Search
CPC ..... A61H 33/025
USPC ..... 4/622
See application file for complete search history.

(56) References Cited

U.S. PATENT DOCUMENTS 2,719,307 A * 10/1955 Reid ..... A01K 13/001 119/673
2009/0089924 A1* 4/2009 Jan ..... A61H 33/025 4/541.5

* cited by examiner

*Primary Examiner* — Lauren A Crane
(74) *Attorney, Agent, or Firm* — Avery N. Goldstein; Blue Filament Law PLLC

(57) ABSTRACT

Disclosed is a disposable for use with a structure having a vessel surface that defines a vessel for receiving liquid. The disposable includes a pad and a layer. The pad has a pair of surfaces spaced apart from one another by a tubular sidewall. The pad is permeable to air flow. One of the pair of surfaces is positioned, in use, against the vessel surface. The layer overlies the other of the pair of surfaces and is at least substantially impermeable to air flow. In use, gas is introduced into the pad and issues through the sidewall in the form of bubbles. The disposable is useful in association with foot spas and the like.

17 Claims, 7 Drawing Sheets

BUBBLE GENERATION SYSTEM

FIELD OF THE INVENTION

The invention relates to the field of skin care.

BACKGROUND OF THE INVENTION

In the field of aesthetics, it is well known to produce pedicure systems including basins which contain heated, roiling water. Known systems are:

relatively costly to manufacture, hard to clean, prone to breakdown.

SUMMARY OF THE INVENTION

Forming one aspect of the invention is a disposable for use with a structure having a vessel surface that defines a vessel for receiving liquid, the disposable comprising a pad and a layer.

The pad has a pair of surfaces spaced apart from one another by a tubular sidewall. The pad is permeable to air flow and one of the pair of surfaces is positioned, in use, against the vessel surface. The layer overlies the other of the pair of surfaces and is at least substantially impermeable to air flow. In use, gas is introduced into the pad and issues through the sidewall in the form of bubbles.

According to another aspect, the one of the pair of surfaces can be a self-adhesive surface adapted to hold the disposable against the vessel surface in use.

According to another aspect, the disposable can further include a release film overlying the self-adhesive surface; and the self-adhesive surface and the release film can be adapted such that the release film can be removed by hand from the pad to expose the self-adhesive surface for use.

According to another aspect, the pad can define a central void; and the disposable can further comprise a tube that extends through the sidewall and into the void.

According to another aspect, the pad can be a foam having about 60 pores per inch.

According to another aspect, the pad can be about ⅛" thick.

According to another aspect, the foam can have properties of about:

i. density 40 kg/m3 ii. tensile strength 108 kpa iii. elongation 184% iv. resilience 45% v. tearing strength 6.19 N/cm

Forming yet another aspect of the invention is a system for use with a structure having a surface that defines a bowl for receiving water, the system including:

the disposables; and apparatus adapted to produce a flow of heated air and to couple to a disposable such that, in use, a flow of heated air issues through the sidewalls into the water contained in the bowl to produce heated, roiling water in the bowl.

Advantages, features and characteristics of the invention will become apparent upon a review of the following detailed description and the appended drawings, the latter being briefly described hereinafter.

DETAILED DESCRIPTION OF THE INVENTION

Figure 1:
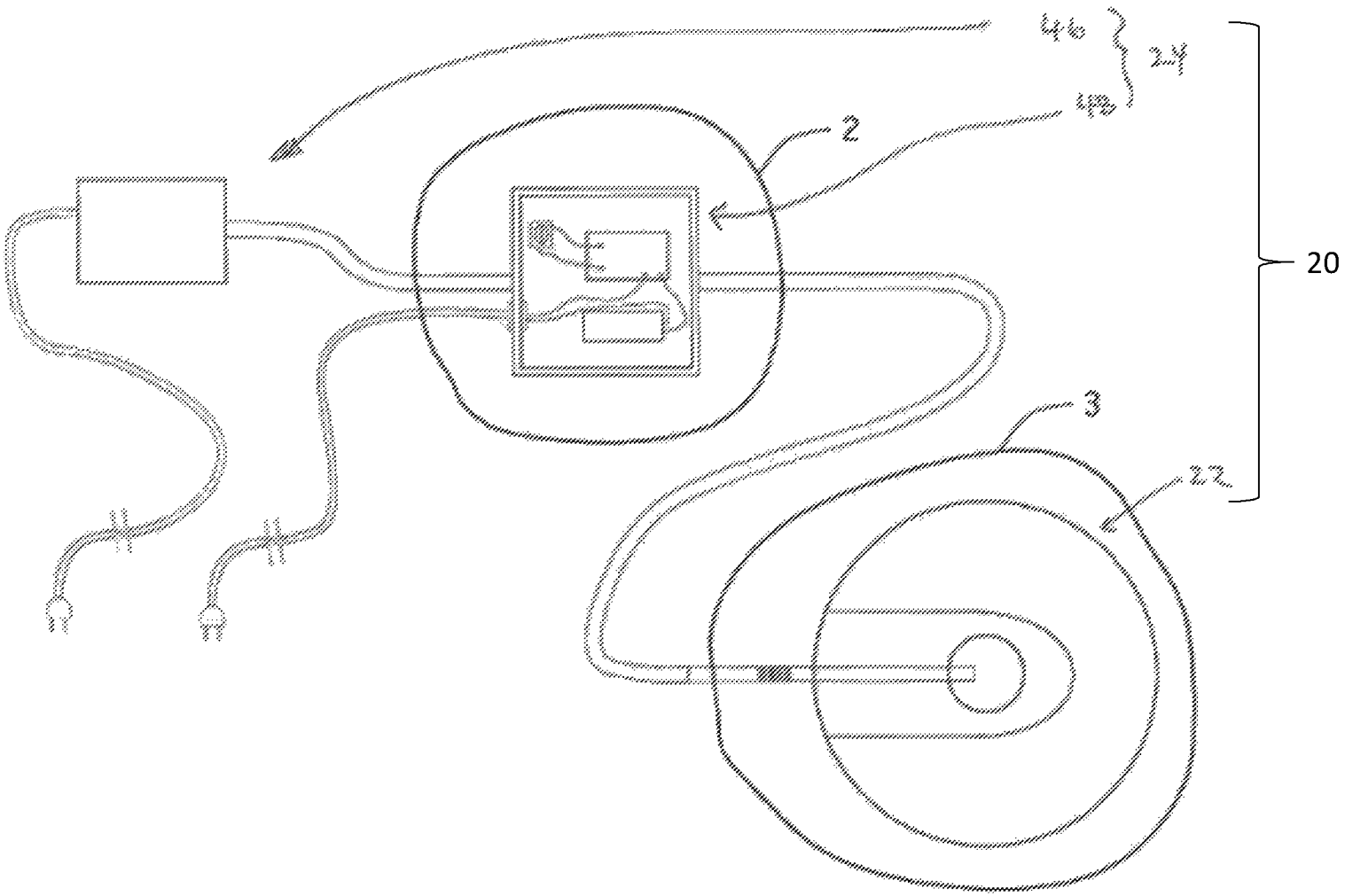
FIG. 1 is a view of the components of a system according to an exemplary embodiment of the invention.

Components of a bubble generation system 20 according to an exemplary embodiment of the invention are shown in FIG. 1 and will be seen to include a disposable 22 and a pump unit 24.

Figure 3:
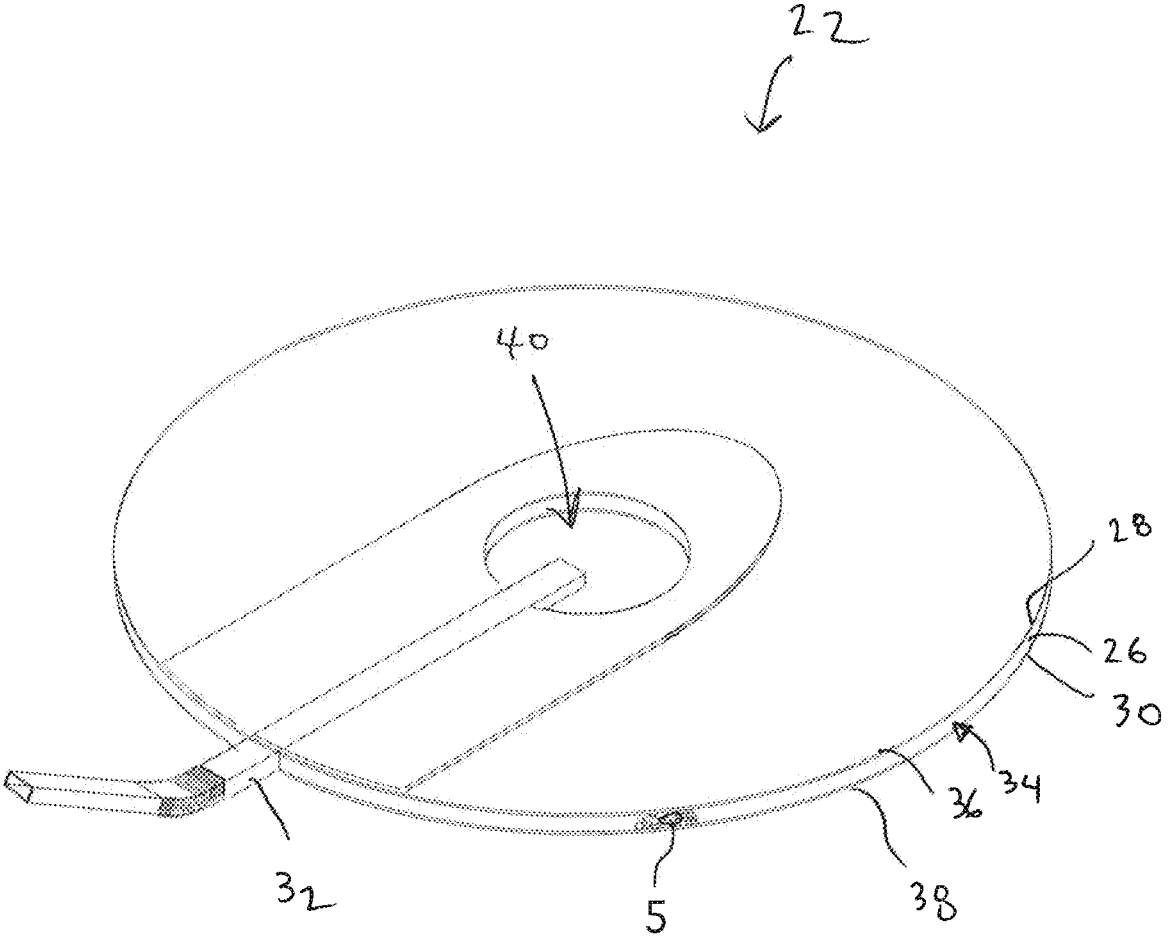
FIG. 3 is an enlarged view of the structure of encircled area 3 of FIG. 1.

The disposable 22 will be seen in FIG. 3 to comprise a pad 26, a seal 28, a release film 30 and a tube 32.

The pad 26:

is about ⅛" thick has a tubular sidewall 34 has a pair of surfaces 36,38 spaced apart from one another by the tubular sidewall 34, one 38 of the pair of surfaces being a self-adhesive surface is permeable to air flow defines a central void 40 is an open cell foam having properties of about:

i. porosity 60 pores per inch.

ii. density iii. tensile strength 108 kpa iv. elongation 184% v. resilience 45% vi. tearing strength 6.19 N/cm

Figure 5:
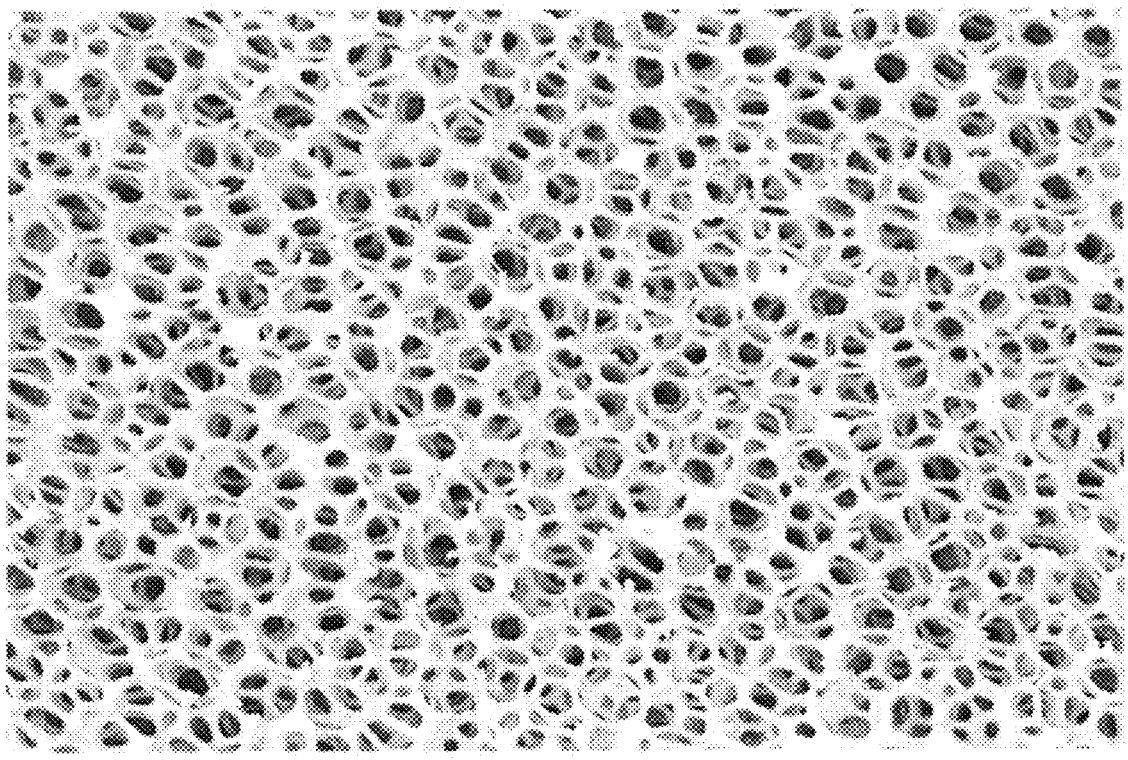
FIG. 5 is an enlarged view of encircled area 5 of FIG. 3

The open cell nature of the foam is evident from FIG. 5.

The seal 28 is a film layer that overlies the other 36 of the pair of surfaces and is at least substantially impermeable to air flow.

The release film 30 lies against the self-adhesive surface 38.

The tube 32 extends through the sidewall 34 and into the void 40.

Figure 4:
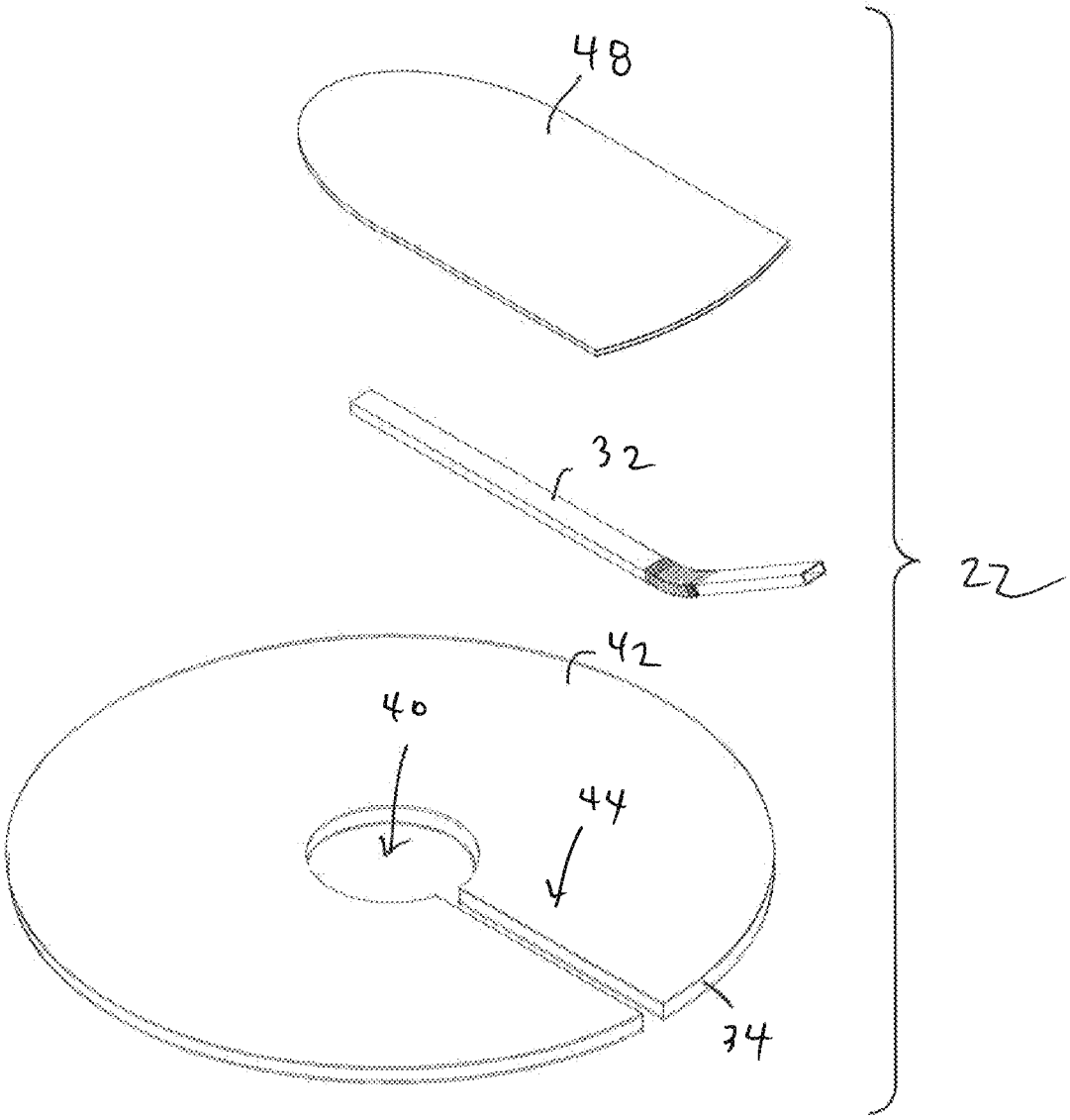
FIG. 4 is an exploded view of the structure of FIG. 3.

An exemplary manner of construction of the disposable is evidenced by FIG. 4.

Herein it will be seen that i. a layer of open cell foam of the contemplated type, over which a film layer 42 is overlaid and the release layer is underlaid, is die stamped to define the sidewall 34, the central void 40 and a channel 44;

ii. the tube 32 is fitted into the channel 44;

iii. a film patch 48 is welded to the film layer 42 to overlie the channel 44 and void 40, the patch 48 and layer 42 collectively defining seal 28

As shown in FIG. 1, the pump unit 24 is defined by a compressor 46 and a conditioner 48.

The compressor 46 is adapted to produce a flow of air and is not further detailed, as it is conventional.

Figure 2:
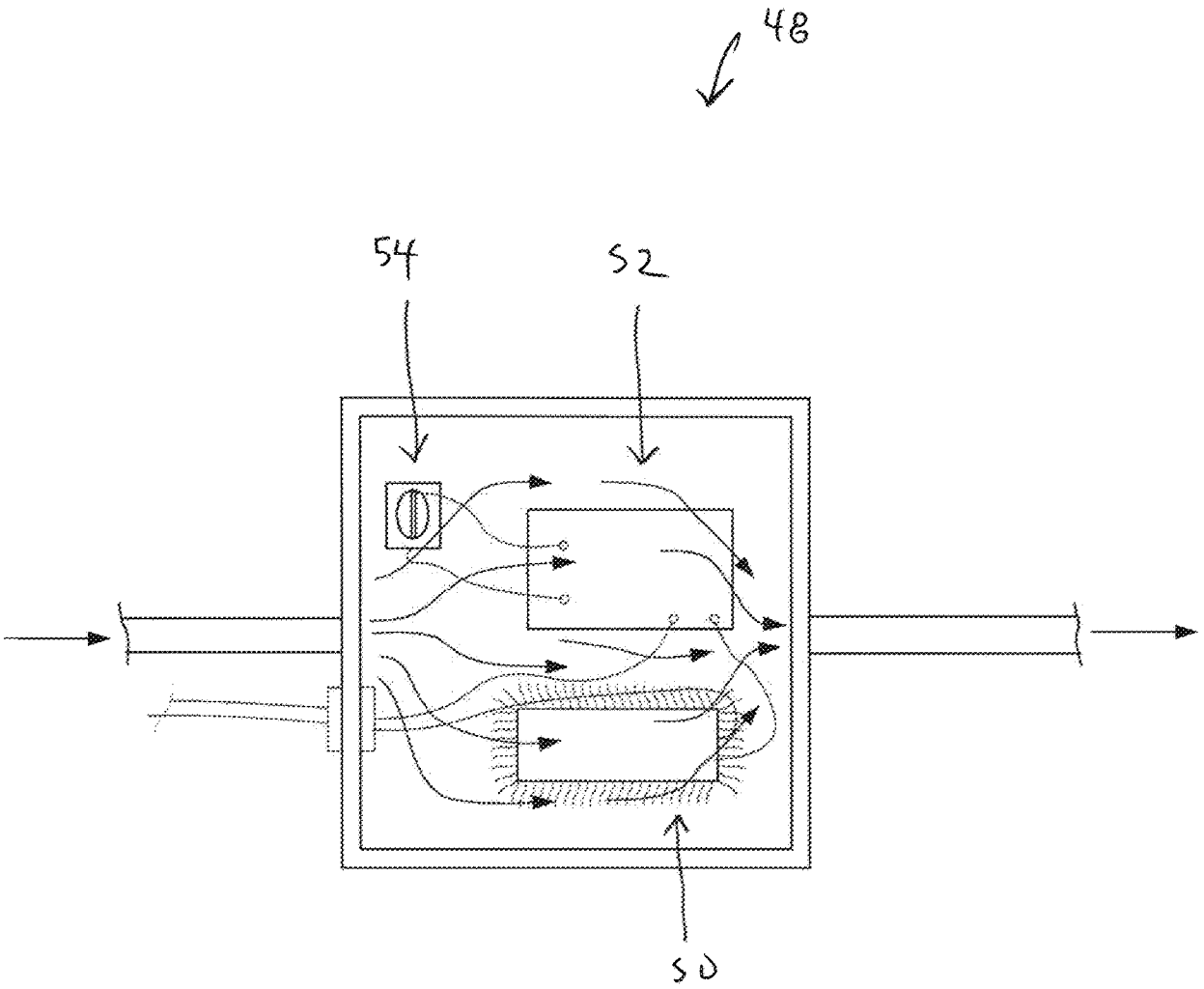
FIG. 2 is an enlarged view of the structure encircled area 2 of FIG. 1

The conditioner 48 is shown in FIG. 2 and will be seen to include a heater 50, a transformer 52 and an ozone generator 54. The heater 50 is a 400 W solid state diode heater, adapted to heat throughpassing air. The step up transformer 52 produces 10000 VAC which powers the ozone generator 54, to produce ozone.

Figure 6:
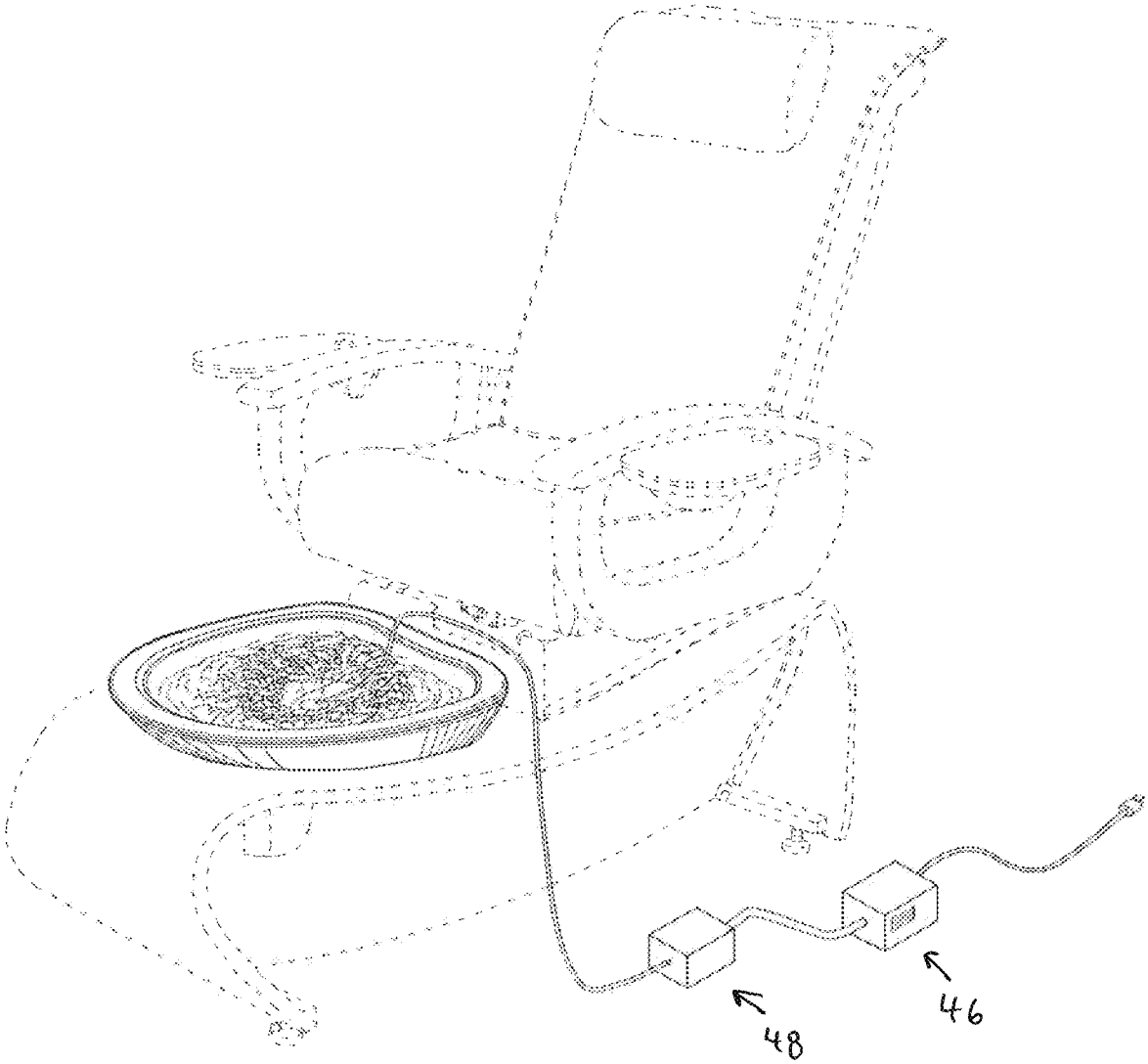
FIG. 6 is a view of the structure of FIG. 1 in use.

The exemplary system is adapted for use with pedicure spa vessels; a prior art vessel of this type is shown in phantom in FIG. 6.

Figure 7:
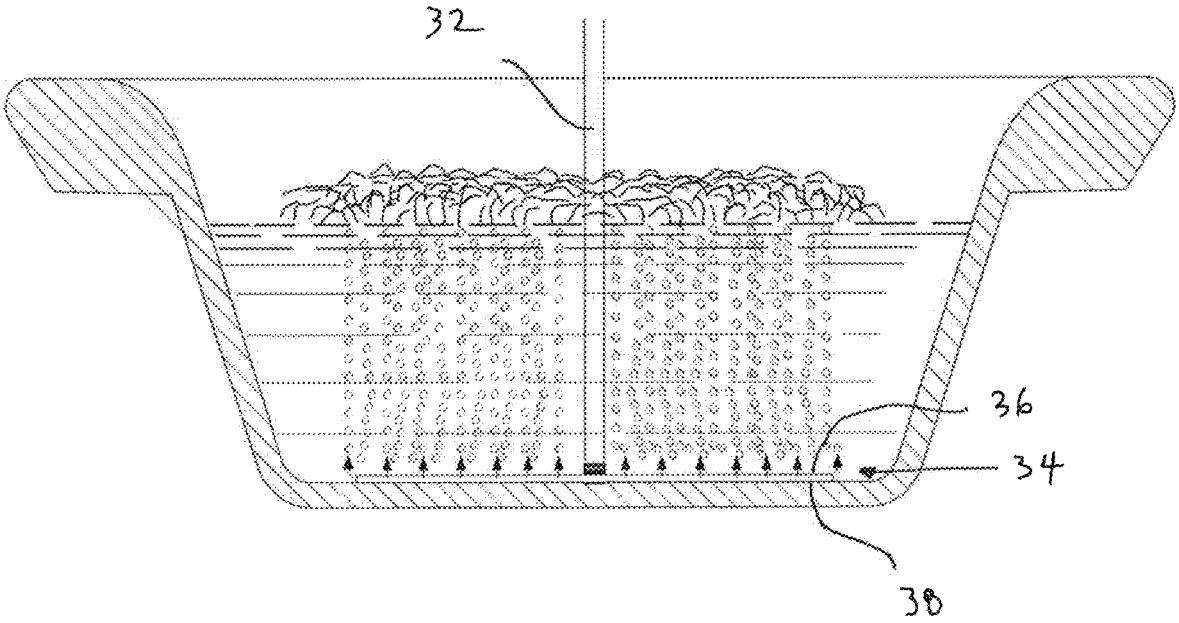
FIG. 7 is a side sectional view of a portion of FIG. 6.

For use, and all as indicated in FIGS. 6 and 7:

a. the release layer 30 is removed from one of the disposables, thereby exposing the self-adhesive surface 38, which, in turn, is secured to the vessel surface;

b. the pump unit 24 is coupled to the tube 32 c. water is placed in the vessel d. the pump unit is activated, thereby to cause heated, ozonated air to: travel through tube 33 into the void 40; traverse the foam; issue through the sidewall 34 in the form of bubbles, thereby producing heated, disinfected roiling water in the vessel.

Persons of ordinary skill will readily appreciate the advantages associated with the system:

the disposable can be removed and replaced regularly, with commensurate advantages in terms of hygiene the disposable is relatively inexpensive to construct the pump is relatively inexpensive to construct and operate, and relatively durable Whereas a specific embodiment is shown, it will be evident that variations are possible.

For example, whereas a self-adhesive layer is shown, this is not strictly necessary as a second impermeable layer could be provided in the place of the self-adhesive layer and the disposable could be secured, for example, by hook and loop fasteners.

Accordingly, the invention should be understood to be limited only by the accompanying claims, purposively construed.

The invention claimed is:

1. A disposable single use bubble generator for use with a pedicure basin having a surface that defines a vessel for receiving liquid, the disposable single use bubble generator comprising: a pad having a pair of surfaces spaced apart from one another by a sidewall, the pad being permeable to air flow, a first surface of the pair of surfaces being configured to be secured to the pedicure basin surface; a seal layer overlying a second surface of the pair of surfaces, the seal layer being at least substantially impermeable to air flow; and a tube having an inlet and an outlet, the inlet configured to be positioned outside of the pad on a first side of the sidewall, the outlet configured to be positioned on a second side of the sidewall, the tube configured to introduce gas into the pad, the pad configured to release gas through the sidewall; and wherein the pair of surfaces are opposing surfaces.

2. The disposable single use bubble generator according to claim 1, further comprising a self-adhesive layer on the first surface of the pair of surfaces, the self-adhesive layer configured to secure the first surface of the pair of surfaces to the pedicure basin surface.

3. The disposable single use bubble generator according to claim 2, further comprising a removable release film overlying the self-adhesive layer, the removable release film configured to be removed by hand to expose the self-adhesive surface.

4. The disposable single use bubble generator according to claim 1, wherein the pad defines a central void and wherein the outlet of the tube is configured to be positioned within the void.

5. The disposable single use bubble generator according to claim 1, wherein the pad is a foam having about 60 pores per inch.

6. The disposable single use bubble generator according to claim 5, wherein the pad is about ⅛" thick.

7. The disposable single use bubble generator according to claim 6, wherein the foam has properties of about:

density 40 kg/m3 tensile strength 108 kpa elongation 184% resilience 45% tearing strength 6.19 N/cm.

8. A bubble generation system for use with a pedicure basin for receiving water, the system comprising:

the disposable single use bubble generator according to claim 1; and an apparatus configured to produce a flow of heated air and to couple to the inlet of the tube, the apparatus being configured to deliver heated air to the tube, the tube configured to introduce the heated air into the pad, the pad configured to release the heated air through the sidewall into the water contained in the pedicure basin to produce heated, bubbling water in the pedicure basin.

9. The disposable single use bubble generator of claim 1, wherein the pad defines a channel configured to receive the tube.

10. The disposable single use bubble generator of claim 1, further comprising a film patch configured to be attached to the first surface of the pair of surfaces over the tube.

11. The disposable single use bubble generator of claim 1, wherein the sidewall is tubular.

12. A disposable single use bubble generator for use with a pedicure basin having a surface that defines a vessel for receiving liquid, the disposable single use bubble generator comprising:

a pad having a pair of surfaces spaced apart from one another by a sidewall and being permeable to air flow, the pad defining a central void, a seal layer placed over a second of the pair of surfaces being at least substantially impermeable to air, a first surface of the pair of surfaces being configured to be secured to the pedicure basin surface;

a tube having an inlet and an outlet, the tube configured to be received by the channel, the inlet configured to be positioned outside of the pad on a first side of the sidewall, the outlet configured to be positioned inside the void, the tube configured to introduce gas into the pad, the pad configured to release gas through the sidewall; and wherein the pair of surfaces are opposing surfaces.

13. The disposable single use bubble generator of claim 12, wherein the central void extends from the first surface to the second surface.

14. The disposable single use bubble generator of claim 12, wherein the channel extends from the sidewall to the central void.

15. The disposable single use bubble generator of claim 12, wherein the channel extends from the first surface to the second surface.

16. The disposable single use bubble generator of claim 12, further comprising a film patch configured to be attached to the first surface of the pair of surfaces over the tube and central void.

17. The disposable single use bubble generator of claim 12, wherein the sidewall is tubular.

* * * * *